United States Patent [19]

Tatai

[11] 4,140,895

[45] Feb. 20, 1979

[54] BIORHYTHM SCALE

[76] Inventor: Kichinosuke Tatai, 12-4-301, Shiroganedai 3-chome, Minato-ku, Tokyo, Japan

[21] Appl. No.: 760,858

[22] Filed: Jan. 21, 1977

[30] Foreign Application Priority Data

Jun. 8, 1976 [JP] Japan ..... 51-74088[U]

[51] Int. Cl.[2] ..... G06C 3/00; G06C 1/02; G09G 3/18

[52] U.S. Cl. ..... 235/89 R; 35/75; 40/17; 40/109; 235/70 A; 235/85 R

[58] Field of Search ..... 235/89 R, 85 R, 85 RC, 235/69, 124, 70 R, 70 B; 35/75, 31 E; 40/17, 109

[56] References Cited

U.S. PATENT DOCUMENTS

| | | | |
|---|---|---|---|
| 2,567,395 | 9/1951 | Peterson, Jr. | 40/109 |
| 3,643,070 | 2/1972 | Dogigli | 235/70 B |
| 3,795,795 | 3/1974 | Gulbransen, Jr. | 235/70 A |
| 3,853,265 | 12/1974 | Kunert | 235/89 R |
| 3,870,225 | 3/1975 | Murphy | 235/89 R |

*Primary Examiner*—Stephen J. Tomsky
*Attorney, Agent, or Firm*—McNenny, Pearne, Gordon, Gail, Dickinson & Schiller

[57] ABSTRACT

A biorhythm scale adapted to secure its operation and capable of directly observing the periodic day and the half-periodic day a physical, sensitive and intellectual rhythm for the individual or individuals in an accurate manner. The biorhythm calculator includes a guide interiorly of which a resilient non-slip element is firmly mounted not only to provide no slippage between vernier scales but also to eliminate an error in reading, and is comprised of a physical rhythm (P) scale, a sensitive rhythm (S) scale, an intellectual rhythm (I) scale, a day scale, and a month scale each of which is provided with racks at least one side thereof. Each of the vernier scales is slid over a fixed date scale indicative of the number of days in a month while in engagement of the racks with the non-slip element to thereby read out the biorhythm in the period as desired.

5 Claims, 9 Drawing Figures

BIORHYTHM SCALE

BACKGROUND OF THE INVENTION

This invention relates to a biorhythm calculator, and more particularly to a readily manipulated biorhythm calculator capable of accurately and stably observing critical days which, on the basis of a biorhythm calendar prepared by the same inventor as for this application, consist of a cycle and a semi-cycle at a periodic change in body and mind conditions such as physical, sensitive or emotional, and intellectual states.

Conventionally, critical days in the biorhythmical conditions have been calculated in such a manner that three values of physical, sensitive, and intellectual on the first day of one's biorhythmical condition to be found are calculated by simple addition and substraction based on the date of one's birth and use of a biorhythm table indicative of biorhythmics. This calculation has been considered as convenient if biorhythm conditions throughout one month are plotted on a calendar by use of a specific indicia scale for biorhythm but involves difficulty in that the scale must be graduated in biorhythmic values other than the date so that various values other than what is plotted on the calendar must be calculated, and the other values may interfere with the value to be found whereby the operator cannot read the figure. In addition, the variety of values to be calculated renders the scale complicated and unreliable in operation. Further, the indicia reference numbers are scattered on the outer surface of the scale and a misalignment of the indicia on the regular scale with those on the vernier may possibly lead the operator to an error in operation and thus to the wrong biorhythm conditions.

SUMMARY OF THE INVENTION

It is, therefore, the primary object of the present invention to provide a new and useful biorhythm calculator to thereby eliminate the aforementioned defects inherent in the conventional biorhythm calculators.

A further object of the present invention is to provide a visual biorhythm condition measuring device which is inexpensive to manufacture, simple to use and which is completely accurate and reliable and stable in operation and application.

Other objects and advantages will become apparent from the following description when considered in the light of the accompanied drawings:

DESCRIPTION OF THE PREFERRED EMBODIMENT

Now, before giving a description of a preferred embodiment of the invention, the principle of biorhythm on which the present invention is based will be explained.

In order to find a biorhythm condition by use of a currently available calendar, a table is prepared for calculation to find the first day, namely, the periodic day for each of these three cycles for physical, sensitive, and intellectual conditions. It has been established that almost all kinds of tragic events such as traffic accidents and other mishaps can be attributed to the cursed day when the victims happened to be in the periodic day or the half-periodic day (middle of the cycle) in the biorhythm conditions. If such phenomenon as biorhythm is practically applied to a modern behavioral sciences in daily life, a better guide principle in one's behavior may be obtained. In other words, by paying attention to the periodic or half-periodic day in the biorhythmic physical, sensitive, and intellectual conditions, one may better adjust to good and bad conditions. This precludes the necessity of seeking for such conditions on the curved line in the conventional chart or table.

As a result, one is able to control his behavior. This is the best way of applying biorhythm. Numerous excellent examples of applications of biorhythm have been introduced by the inventor in his various reports and the like.

Figure 1:
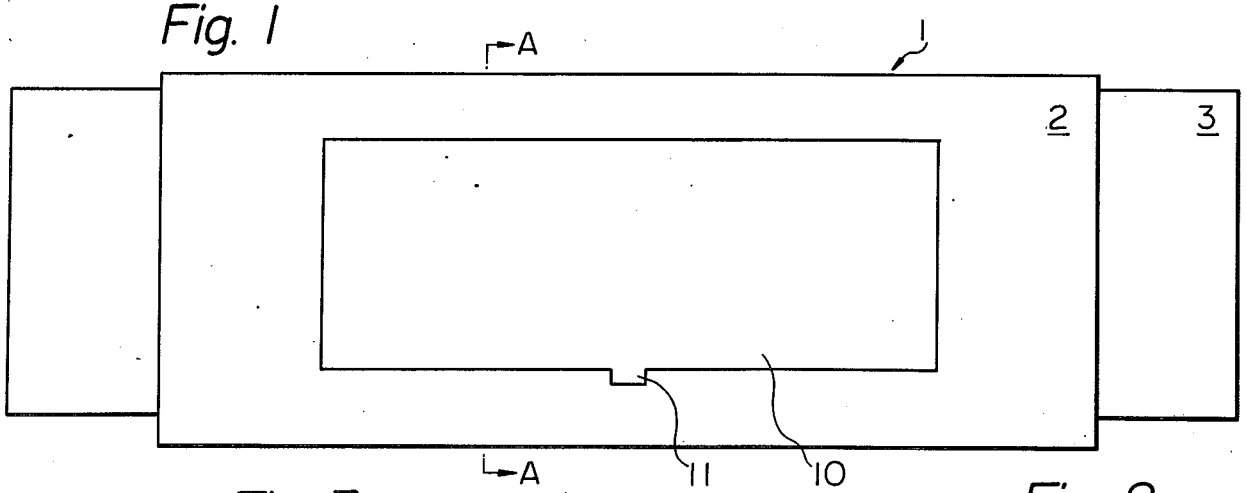
FIG. 1 is a front elevational view of a biorhythm calculator according to the present invention.
Figure 2:
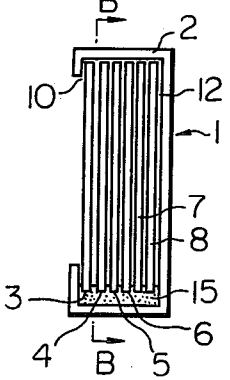
FIG. 2 is a cross sectional view taken along the line A—A of FIG. 1.

Referring now to the drawing in detail wherein a biorhythm calculator of the present invention enables the user to accurately and simply read the periodic day or the half-periodic day in the three biorhythm conditions according to the year and the month as desired. The instrument body member 1 includes a transparent, generally rectangular guide 2 formed of plastic material and transparent, generally rectangular scale means formed of plastic material and mounted in the guide 2 for slidable and reliable movement therein. As shown in FIGS. 1 and 2, scale means consists of, for instance, five verniers 3, 4, 5, 6, and 7, and a fixed scale 8 made longer than the verniers. The guide 2 is so mounted as to encircle the verniers and the scale in a stack. The guide 2 is provided with a read-out window 10 centrally thereof. A notch 11 is formed centrally and downwardly of the window to read the month.

Figure 9:
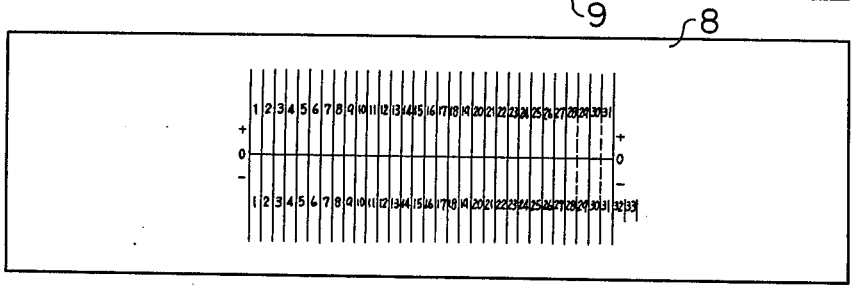
FIG. 9 is a plan view of a sixth scale showing calendar dates.

The plastic vernier scale or plate 3 is a physical (P) rhythm scale indicative of a 23-day cycle. The vernier scale 4 is a sensitive (S) rhythm scale indicative of a 28-day cycle. The vernier scale 5 is an intellectual (I) rhythm scale indicative of a 33-day cycle. A scale or a plate 6 is a day scale on which the word "Sunday" is repeatedly inscribed in regularly spaced relationship. A scale or a plate 7 is a month scale on which calendar months are inscribed in order. A scale or a plate 8 is a one-month scale of opaque, white plastic sheet on which the number of days in a month are arranged (Since the cycle for intelligence will cover 33 days, "32nd" and "33rd" are so described in the lower line on the plate 8 as to correspond to 1st and 2nd for convenience of calculation although they are actually nonexistent. A plurality of racks 9 are so formed in each of the scales or plates 3–7 at the longitudinal, lower side and substantially entire length thereof that the face width of each of the racks corresponds to a section which encircles an entry of the date. On the other hand, the fixed date scale 8 is provided with no such rack, as shown in FIG. 9, and adapted to have its lower side to the guide or the guide with the read-out window.

Figure 3:
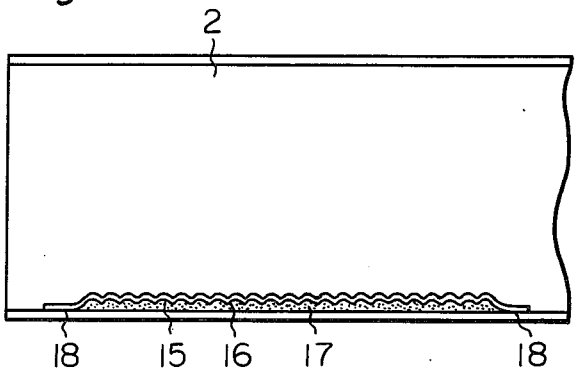
FIG. 3 is a sectional view taken along the line B—B of FIG. 2.
Figure 4:
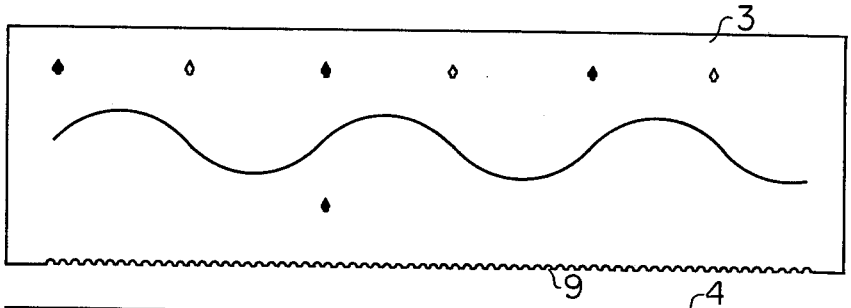
FIG. 4 is a plan view of a first scale on which a physical condition is plotted.
Figure 5:
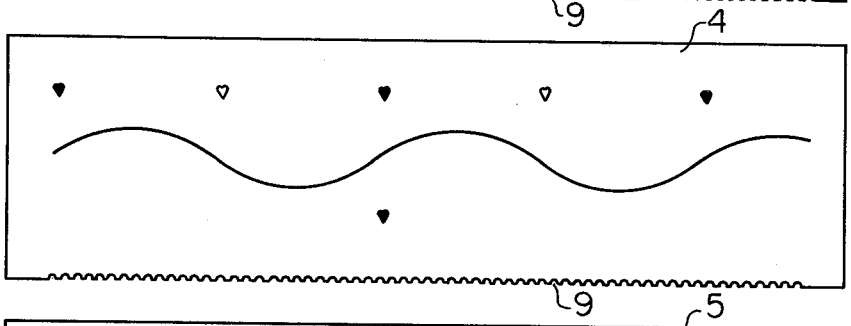
FIG. 5 is a plan view of a second scale on which a sensitive condition is plotted.
Figure 6:
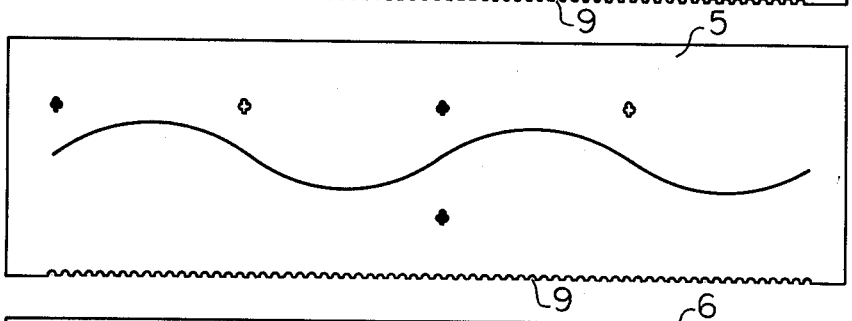
FIG. 6 is a plan view of a third scale on which an intellectual condition is plotted.
Figure 7:
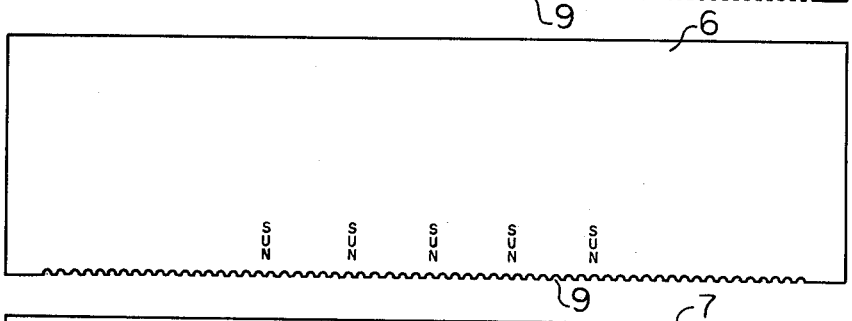
FIG. 7 is a plan view of a fourth scale showing the days of the week.
Figure 8:
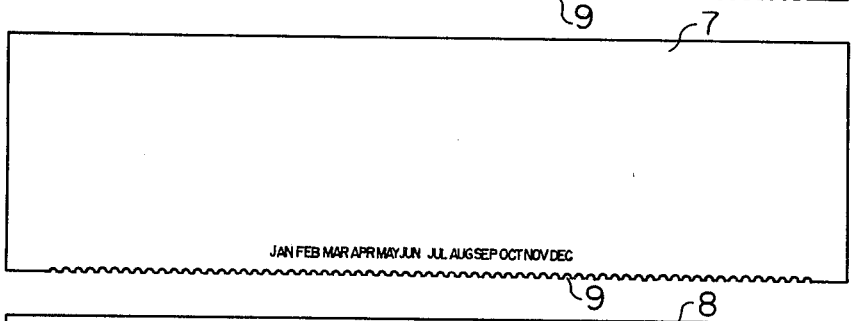
FIG. 8 is a plan view of a fifth scale showing calendar months.

Referring to FIGS. 2 and 3, a corrugated non-slip element 15 is secured to the upper or lower side of the guide 2 of the calculator 1 to mesh with the racks formed each of the scales 3–7. The fixed date scale 8 indicative of days in a month is adapted to have its lower longitudinal side embedded in the non-slip element 15 and bonded thereto. A corrugated sheet 16 which covers the exterior of the non-slip element 15 is so configurated or shaped within the guide 2 as to mesh with the racks of each of the scales and to enable step movement of each of the scales. The non-slip element 15 is secured by suitable means for bonding the opposite ends 18 of the sheet 16 to the interior of the guide 2. A resilient layer 17 of non-rigid plastic form materials such as polyurethane foam or the like is held between the corrugated sheet 16 and the guide 2.

As the calculator according to the present invention is fabricated as aforementioned, the racks 9 of each of the vernier scales 3–7 mesh with the corrugation of the sheet 16 of the non-slip element with respect to the guide or the fixed scale 8 to enable each of the vernier scales 3–7 to undergo a step movement thereof in a click fashion in that resilient interlocking with each of the recesses of the racks is provided. Consequently, no slippage between the vernier scales is made in relation to the fixed scale 8 to set these scales at one point. It is understandable therefrom that malfunction derived from a continuous slide movement of the conventional transparent vernier scales and fine, complicated adjustment of the vernier scales to the narrow widths of the date indicia, are simultaneously eliminated to enable the user to simply operate the calculator.

The corrugated resilient structures 16, 17 of the non-slip element 15 in which polyurethane foam is held enables the vernier scale to effect a click displacement or a step movement thereof. With this simple arrangement, a resilient pressure contact between the plastic vernier scale and the guide or the fixed scale to secure a simple setting of the vernier scale is provided.

In use, the physical, sensitive, and intellectual scales 3, 4, and 5 are slidably moved until a playing card mark on the lower portion of each scales align with the date on the date scale 8, the date which is obtained upon calculation based on the specific table prepared by the inventor. More specifically, supposing that "5" is obtained from the specific table, the playing card mark (for instance, spade) indicative of physical condition is arranged to lie above the date, 5th (in the month to be sought). As a result, it has been found that the periodic days are 5th and 28th whereas 16th is the half-periodic day, and that a positive condition cover 6th –15th and the period from 29th on while a negative condition covers 17th–27th. It is noted that the intellectual rhythm of the biorhythm conditions will last for 33 days so that the values "32" or "33" may be rarely obtained depending upon circumstances. This means that residual 32 or 33 on the date scale in observing the intellectual rhythm is carried forward to the next month due to nonexistence of 32nd and 33rd in an actual month. In this instance, the playing card mark (clover) is arranged to lie over the dates, 32nd and 33rd on the scale.

It is preferable to align a "SUN" mark in the scale 6 with the date in the date scale 8 so as to use the transparent month scale 7 and the fixedly disposed date scale 8 as a monthly calendar if required. Thus, a week day can be automatically indexed. In this connection, though the indication of "JAN" through "DEC" is not necessarily to be employed when the scales are used as a monthly calendar, by disposing the month concerned over the notch 11 of the window it serves to conveniently confirm the month during manipulation of the scales. The month scale 7 may be stationary to prevent any month from appearing over the notch 11 of the window if no indication of month is required.

Having thus described the preferred embodiment of the invention it should be understood that numerous structural modification and adaptations may be resorted to without departing from the spirit of the invention.

What is claimed is:

1. A biorhythm calculator comprising a guide for adjustably mounting at least three vernier scales such as a physical rhythm scale, a sensitive rhythm scale, and an intellectual rhythm scale, each of the vernier scales comprising a sheet member on which a respective cycle curve line is drawn and having racks at one side thereof, at least one fixed scale including a date scale with no rack, said fixed scale being rigidly mounted on said guide, and a slip-free element carried by said guide and having a corrugated sheet engageable with said racks of each vernier scale and a resilient foam material with which said corrugated sheet surface is lined to resiliently bias each of said vernier scales against an opposed surface of said guide to retain said scales in selected positions.

2. A biorhythm calculator as set forth in claim 1 wherein each of said racks comprises a serrated edge of each of said sheet members, and each of said serrated edges includes regularly spaced recesses having widths corresponding with the corrugations of said slip-free element and the spacing of date indicia set forth on said date scale.

3. A biorhythm calculator as set forth in claim 1 wherein each of said vernier scale sheet members is a transparent plastic sheet on which the respective cycle curve line is drawn and said racks comprise a serrated edge of said plastic sheets.

4. A biorhythm calculator as set forth in claim 1 wherein said resilient foam material is polyurethane.

5. A biorhythm calculator as set forth in claim 1 wherein said slip-free element is at its opposite ends bonded to the interior of said guide.

* * * * *